United States Patent [19]

Kanoto

[11] Patent Number: 4,589,654

[45] Date of Patent: May 20, 1986

[54] SHEET ALIGNING DEVICE

[75] Inventor: Masanobu Kanoto, Tokyo, Japan

[73] Assignee: Canon Kabushiki Kaisha, Tokyo, Japan

[21] Appl. No.: 565,365

[22] Filed: Dec. 27, 1983

[30] Foreign Application Priority Data

Jan. 7, 1983 [JP] Japan ..... 58-969

[51] Int. Cl.[4] ..... B65H 29/22; B65H 31/34

[52] U.S. Cl. ..... 271/314; 271/184; 271/236

[58] Field of Search ..... 271/314, 109, 184, 208, 271/225, 234, 236, 238, 248, 249, 250, 251, 264; 270/53; 361/214

[56] References Cited

U.S. PATENT DOCUMENTS

| | | | |
|---|---|---|---|
| 4,017,066 | 4/1977 | Lasher et al. | 271/314 |
| 4,029,309 | 6/1977 | Lynch et al. | 270/53 |
| 4,049,256 | 9/1977 | Church et al. | 271/236 X |
| 4,359,219 | 11/1982 | Garavuso | 271/236 |
| 4,474,457 | 10/1984 | Phelps | 361/214 |

OTHER PUBLICATIONS

Ewing, J. R., "Conductive Rolls", Xerox Disclosure Journal, vol. 7, No. 2, Mar./Apr. 1982, p. 93.

*Primary Examiner*—Bruce H. Stoner, Jr.
*Assistant Examiner*—Lawrence J. Goffney, Jr.
*Attorney, Agent, or Firm*—Fitzpatrick, Cella, Harper & Scinto

[57] ABSTRACT

This specification discloses a sheet aligning device for aligning conveyed sheets by bringing rotatable paddles comprising a plurality of flexible members into contact with two surfaces substantially orthogonal to each other and in which the sheets are aligned by a rotatable main paddle member for imparting to the sheet a draw-in force in the direction of intersection of the two surfaces substantially orthogonal to each other and a rotatable auxiliary paddle member for causing the sheet to be conveyed to one of the two surfaces with a draw-in force weaker than the draw-in force of the main paddle member.

6 Claims, 3 Drawing Figures

SHEET ALIGNING DEVICE

BACKGROUND OF THE INVENTION

1. Field of the Invention

This invention relates to a sheet aligning device in a copying apparatus, a printing machine, a recording machine or other various machines provided with a mechanism for supporting and containing sheets (hereinafter simply referred to as the copying apparatus or the like).

2. Description of the Prior Art

Some sheet aligning devices of this type in the copying apparatus or the like have been such that, for example, a rotatable paddle made of a plurality of elastic members of rubber or like material is directed in the direction of intersection of two surfaces substantially orthogonal to each other and is brought into contact with a sheet, whereby the sheet is aligned along guide members forming the two orthogonal surfaces, but when the sheet is curled or otherwise deformed, particularly, when the amount of sheets supported increases, there has been a disadvantage that sheet alignment is liable to be disturbed particularly in a portion spaced apart from the paddle.

SUMMARY OF THE INVENTION

In view of such disadvantage, it is an object of the present invention to provide an improved novel sheet aligning device.

It is another object of the present invention to provide a sheet aligning device which enables even curled or otherwise deformed sheets to be well aligned.

That is, the major construction of the present invention which can achieve the above objects consists in a sheet aligning device for aligning conveyed sheets by bringing rotatable paddles comprising a plurality of flexible members into contact with a sheet to be aligned against two surfaces substantially orthogonal to each other, characterized by a rotatable main paddle member for imparting to the sheet a draw-in force in the direction of intersection of the two surfaces substantially orthogonal to each other, and a rotatable auxiliary paddle member for causing the sheet to be conveyed to one of the two surfaces with a draw-in force weaker than the draw-in force of the main paddle member.

According to the construction of the present invention as described above, sheet alignment can be accomplished sufficiently well even when sheets are curled or otherwise deformed or even when the amount of sheets supported increases.

The invention will become more fully apparent from the following detailed description thereof taken in conjunction with the accmpanying drawings.

DETAILED DESCRIPTION OF THE PREFERRED EMBODIMENTS

Figure 1:
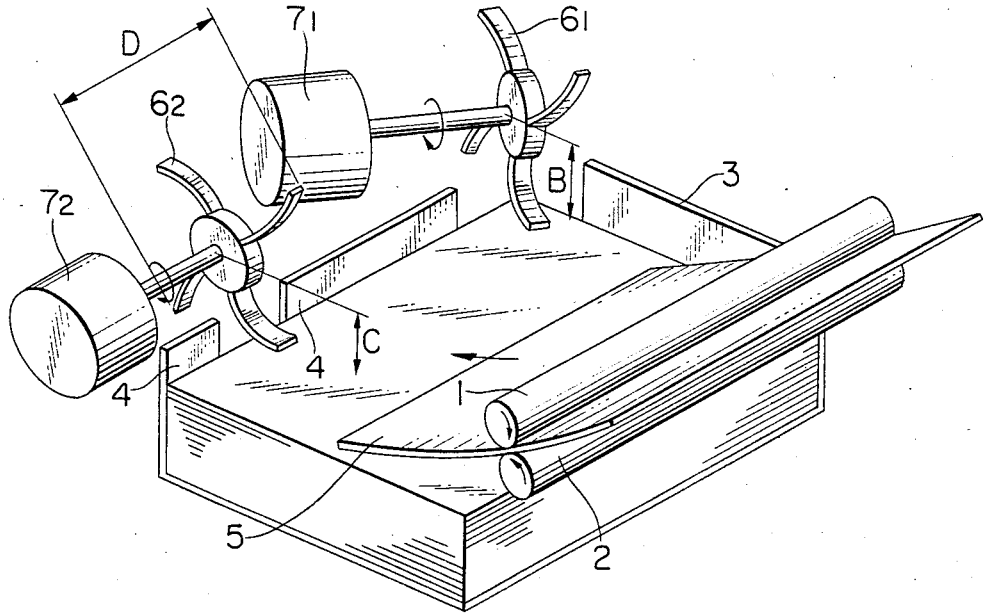
FIG. 1 is a perspective view showing an embodiment of the present invention.

Specific embodiments of the present invention will hereinafter be described in detail by reference to the drawings. FIG. 1 is a perspective view showing an embodiment of the present invention. In FIG. 1, reference numerals 1 and 2 designate a pair of paper discharge rollers which serve to feed paper 5 into the aligning device. Reference numerals 3 and 4 denote guide members whose planes are orthogonal to each other and which serve to bear against two side edges of the paper 5 and position the paper 5. A main paddle $6_1$ and an auxiliary paddle $6_2$ have their tip ends formed of an elastic or flexible material such as rubber and are rotated in the direction of the associated arrows by motors $7_1$ and $7_2$, respectively. The paddle $6_1$ faces the guides 3 and 4, and the paddle $6_2$ draws the paper toward the guide 4.

In the above-described construction, the paper 5 can be reliably positioned and aligned by the guides 3 and 4. Particularly, even if the paper is curled, the curl may be held down by the pressure force of the paddle $6_2$ and one side edge of the paper 5 may be reliably positioned by the guide 4. Of course, one lateral side edge of the paper 5 may be positioned and aligned along the guide 3 by the action of the paddle $6_1$.

Figure 2:
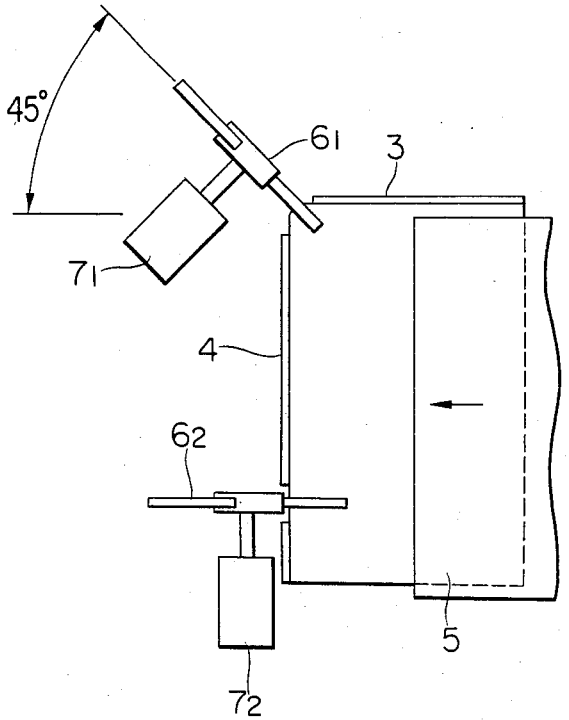
FIG. 2 is a plan view of the FIG. 1 embodiment.
Figure 3:
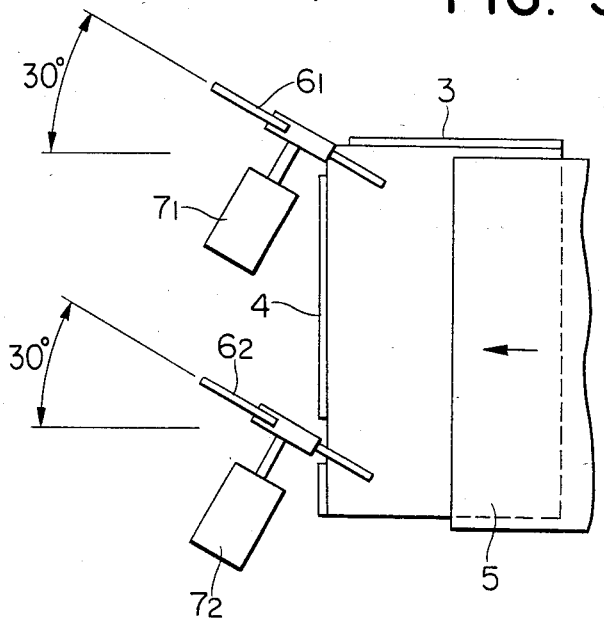
FIG. 3 is a plan view of showing another embodiment of the present invention.

Preferably, the material forming the tip end of the paddle 6 may be, for example, electrically conductive rubber to prevent their friction charging with the paper. According to experiment, it has been found that the following angles are most preferable as the angle between the draw-in direction of the paddles and the direction of entry of the paper. That is, the paddle $6_1$ should be inclined by 45° with respect to the direction of movement of the paper and the paddle $6_2$ should be inclined by 0° with respect to said direction (FIG. 2), or the paddle $6_1$, should be inclined by 30° and the paddle $6_2$ should be inclined by 30°, with respect to the direction of movement of the paper (FIG. 3).

This is because, if both the paddle $6_1$ and the paddle $6_2$ are inclined by 45°, the lateral paper draw-in force will become stronger and if the paddle $6_1$ is inclined by 30° and the paddle $6_2$ is inclined by 0°, the lateral paper draw-in force will be weaker.

The best angle of the paddles with respect to the direction of movement of the paper is variable by the difference in draw-in force between the paddles themselves.

Preferably, the paper draw-in force of the paddle $6_2$ may be somewhat weaker than the paper draw-in force of the paddle $6_1$, and this can be accomplished as by making the diameter of the paddle $6_2$ somewhat smaller than the diameter of the paddle $6_1$ or mounting the paddle $6_2$ at a position somewhat higher than the paddle $6_1$. In the embodiment illustrated, a good result has been obtained by adopting 100 mm as the diameter D of the paddles $6_1$ and $6_2$ and mounting the paddles $6_1$ and $6_2$ at a height of B=30 mm and a height of C=35 mm, respectively, in FIG. 1.

The above-described result has been obtained under the following conditions:

paper conveyance speed: about 500 mm/sec.

peripheral speed of paddle tip ends: about 1300 mm/sec.

shape of the rubber of paddle tip ends: width 10 mm thickness 2 mm and the best mounting height is variable by a difference in these conditions.

Also, in the above-described embodiment, the paper supporting table may be designed to be elevated or lowered in order to ensure the best support height of the paper to be kept constant. The number of paddles may also be three or more, but as a result of the experiment, two paddles have been sufficient.

What I claim is:

1. A sheet aligning device comprising:

a sheet receiving member for superposedly stacking sheets advancing thereto;

sheet positioning means for positioning two sides of the stacked sheets orthogonal to each other;

main displacing means opposed to an advancing corner of the advancing sheet, said main displacing means frictionally contacting the advancing sheet at said corner to displace said advancing sheet in an oblique direction to the advancement so as to bring said sheet into contact with said sheet positioning means; and an auxiliary displacing means opposed to an advancing side of said advancing sheet, said auxiliary displacing means displacing said advancing sheet forwards with a weaker displacing force than that of said main displacing means so as to help said positioning.

2. A device according to claim 1, wherein each of said main and auxiliary displacing means comprises a paddle member.

3. A sheet aligning device according to claim 2, wherein said paddle member of the main displacing means is disposed at an angle of about 45° with respect to the advancing direction of the sheet, and said paddle member of the auxiliary displacing means is disposed at a null angle with respect to said advancing direction.

4. A sheet aligning device according to claim 2, wherein both of said paddle members are disposed at an angle of about 30° with respect to the advancing direction of the sheet.

5. A sheet aligning device according to claim 2, wherein the diameter of said paddle member of the auxiliary displacing means is smaller than that of of said paddle member of the main displacing means.

6. A sheet aligning device according to claim 2, wherein said paddle member of the auxiliary displacing means is disposed at a higher position than said main displacing means.

* * * * *